United States Patent [19]

York et al.

[11] Patent Number: 4,651,450

[45] Date of Patent: Mar. 24, 1987

[54] PACKER BAR ASSEMBLY

[75] Inventors: Randall A. York, Huntington Beach; Charles W. Gladding, Mammoth Lakes, both of Calif.

[73] Assignee: FallLine Corporation, Huntington Beach, Calif.

[21] Appl. No.: 598,999

[22] Filed: Apr. 11, 1984

[51] Int. Cl.[4] ..... E01H 4/00

[52] U.S. Cl. ..... 37/197; 37/219; 15/236 R; 172/189; 172/612

[58] Field of Search ..... 37/219, 221, 231-233, 37/196-197, 141 R, 266, 268, 269; 15/236 R, 93 R; 172/72, 445.1, 612, 189, 193-194, 747, 197, 199-200

[56] References Cited

U.S. PATENT DOCUMENTS

| | | | |
|---|---|---|---|
| 422,566 | 3/1890 | Briggs | 37/266 |
| 1,439,832 | 12/1922 | Merrill | 37/232 |
| 1,937,243 | 11/1933 | Pearch | 37/266 |
| 2,061,585 | 11/1936 | Meyer | 37/233 |
| 3,021,626 | 2/1962 | Eyolfson | 37/141 R |
| 3,032,901 | 5/1962 | Dils, Jr. | 37/141 R |
| 3,465,456 | 9/1969 | Meyer | 37/233 |
| 3,466,766 | 9/1969 | Kahlbacher | 37/233 |
| 3,773,375 | 11/1973 | Nehis | 37/268 |
| 3,829,991 | 8/1974 | Cheney | 37/221 |
| 3,851,711 | 12/1974 | Stepe | 37/141 R |
| 3,884,498 | 5/1975 | Cote, Jr. | 37/219 |
| 3,914,885 | 10/1975 | Moreau | 37/141 R |
| 4,202,118 | 5/1980 | Held | 37/219 |
| 4,341,027 | 7/1982 | Rohner | 37/197 |
| 4,359,831 | 11/1982 | Beeley | 37/258 |

FOREIGN PATENT DOCUMENTS

| | | | |
|---|---|---|---|
| 2039572 | 8/1980 | United Kingdom | 37/219 |

OTHER PUBLICATIONS

"Snow Texturing & Grooming Accessories", FallLine Corp. advertising brochure, two pages ©1984, revised 9-5-84.

*Primary Examiner*—E. H. Eickholt

*Attorney, Agent, or Firm*—Knobbe, Martens, Olson & Bear

[57] ABSTRACT

The blades of a packer bar assembly for grooming snow are made of flexible material, such as urethane. The blades are removably mounted in channel members and the mounting assembly is arranged to hold the blade in a desired position.

22 Claims, 10 Drawing Figures

PACKER BAR ASSEMBLY

BACKGROUND OF THE INVENTION

This invention relates to apparatus for grooming snow on ski slopes. In recent years, the skiing industry has grown significantly larger due to the seemingly ever-increasing numbers of people who have the interest, time, and money to participate in such sport. To satisfy this demand, it has become customary to groom the snow ski slopes in a manner to improve skiing conditions.

Freshly fallen snow does not usually provide ideal skiing conditions for most skiers. Often such new fallen snow is too soft and requires packing. In other instances, newly fallen snow may result in many drifts that interfere with skiing, thus requiring leveling; or conditions may be such that there has been formed a hard surface crust that requires breaking. Similarly, after large numbers of people have skied on a slope, the snow may have become too packed in some areas or may have become so uneven as to make skiing difficult. Also, a skiing surface will often melt on the surface during the day and then freeze at night, which is likely to result in a surface condition that is undesirably crusty. After soft snow has been packed, drifted snow has been dispersed, or crusted snow has been broken up, it is desirable that the resulting surface be relatively uniformly groomed so as to enhance skiing conditions.

Typically, the apparatus that has been developed for grooming the snow includes a tractor-like vehicle having wide, flat, track-like surfaces that enable the vehicle to traverse the ski slopes. On the front of such vehicle is usually positioned a blade for scraping or pushing snow. On the rear of the vehicle is usually provided a packer bar assembly for packing, leveling, and combing the snow so as to leave a uniform, slightly grooved surface. Prior packer bar assemblies typically include a series of metal blades or blade segments that are positioned together in side by side, edge to edge relation to provide a blade or blade assembly of a desired width. The lower portions of the blade engaging the snow are usually provided with ridges or comb-like elements to provide the desired finished surface. Typically, the blade assembly is mounted so that it may be raised or lowered by suitable means, such as hydraulic rams, to vary the pressure on the snow or the extent to which the blade cuts into the snow. Normally, the blade is mounted at an angle with respect to the snow surface, and in some arrangements, the angle can be varied to improve the grooming operation. While this type of packer bar apparatus has been very beneficial for improving the condition of the snow skiing surfaces, it has a number of shortcomings.

It is difficult for an operator to determine the desired downward setting or angle setting of the blade assembly. This is so even with a ski slope having a fairly uniform condition. However, this problem is compounded with a typical ski slope condition wherein the angle and position of the blade should preferably be continuously adjusted. Moreover, even with a single pass of the grooming apparatus, certain portions of the terrain should preferably be treated differently than with others, but this is difficult or impossible to do with a relatively wide, rigid blade assembly. As a result of these difficulties, operators frequently compromise by setting the blade assembly at a position which hopefully will provide acceptable results, without much adjustment being made during operation.

The metal blade assembly is also relatively heavy, and consequently difficult for personnel to handle when replacing blade segments. The weight translates into increased fuel costs in moving the assembly during the grooming operations. The blade assemblies are also subject to corrosion and are relatively expensive.

Some attempts have been made to improve the snow grooming apparatus by utilizing somewhat flexible, comb-like elements attached to the lower ends of metal blade assemblies. However, a need still exists for further improvements in the apparatus available for grooming snow.

SUMMARY OF THE INVENTION

Briefly stated, the present invention comprises a packer bar assembly having a blade assembly formed of relatively flexible blade segments or panels made of a rugged, durable material, such as polyurethane. There are a number of advantages of such a blade assembly, the primary one being that the urethane blade segments will flex to accommodate or adapt to the condition of the snow over which it is passing. For example, if the blade encounters relatively soft snow, the blade stiffness will cause the blade to be relatively straight and uncurved. By contrast, if the blade encounters relatively hard snow, it will flex, changing its angle with respect to the snow surface so as not to dig further into the snow, as would a rigid metal blade assembly.

Another advantage of the flexible blade assembly of the invention is that if an obstruction is encountered in one section of the blade, that section can flex a considerable amount to pass over the obstruction without damage, whereas a rigid blade assembly must either move the obstruction or give way itself, probably resulting in damage to the apparatus. Periodically, it is necessary to replace blade segments, and the polyurethane segments are much easier to handle during such replacement operations than are heavy metal segments. Advantageously, snow tends to not stick to the urethane material, which is desirable. Also, the material is less expensive than metal but yet is very durable.

In a preferred arrangement, the flexible blade segments are provided with a tongue and groove contruction on their adjacent side edges that facilitates the assembly and disassembly of the blade assembly. Also, a unique mounting arrangement is provided to produce the necessary downward force on the flexible blade assembly.

DESCRIPTION OF THE PREFERRED EMBODIMENT

Figure 1:
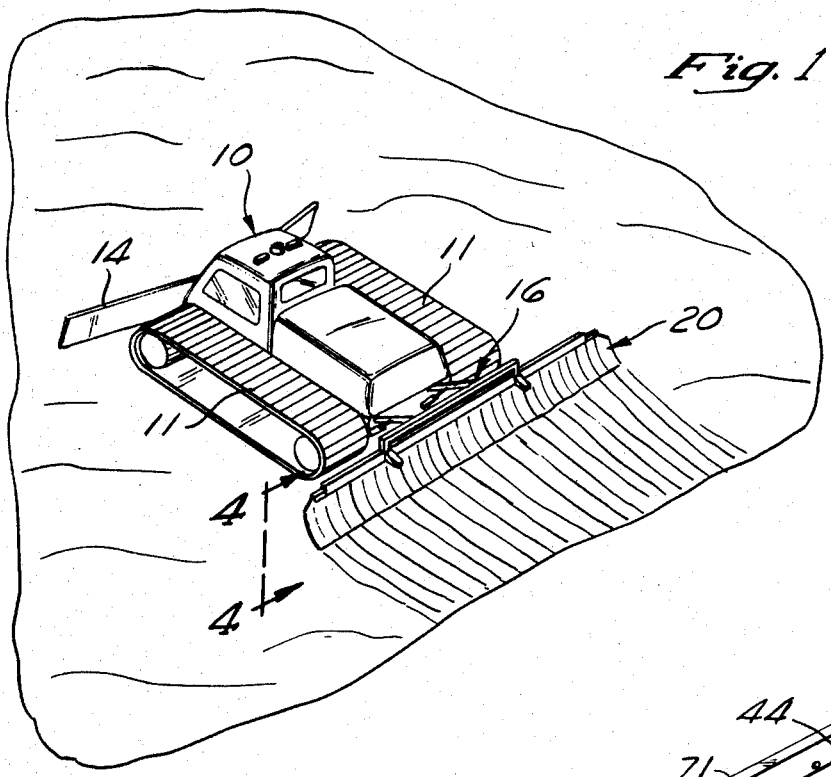
FIG. 1 is a top perspective view of the snow packer bar assembly attached to a snow vehicle.

Referring to FIG. 1, there is illustrated a tractor-like vehicle 10 having suitable tracks 11 that are sufficient to enable the vehicle to move easily on snow. A snow moving blade 14 is positioned on the forward end of the vehicle. The packer bar assembly 16 includes a blade assembly 20 and a support structure 39 mounting or connecting the blade assembly to the vehicle.

Figure 2:
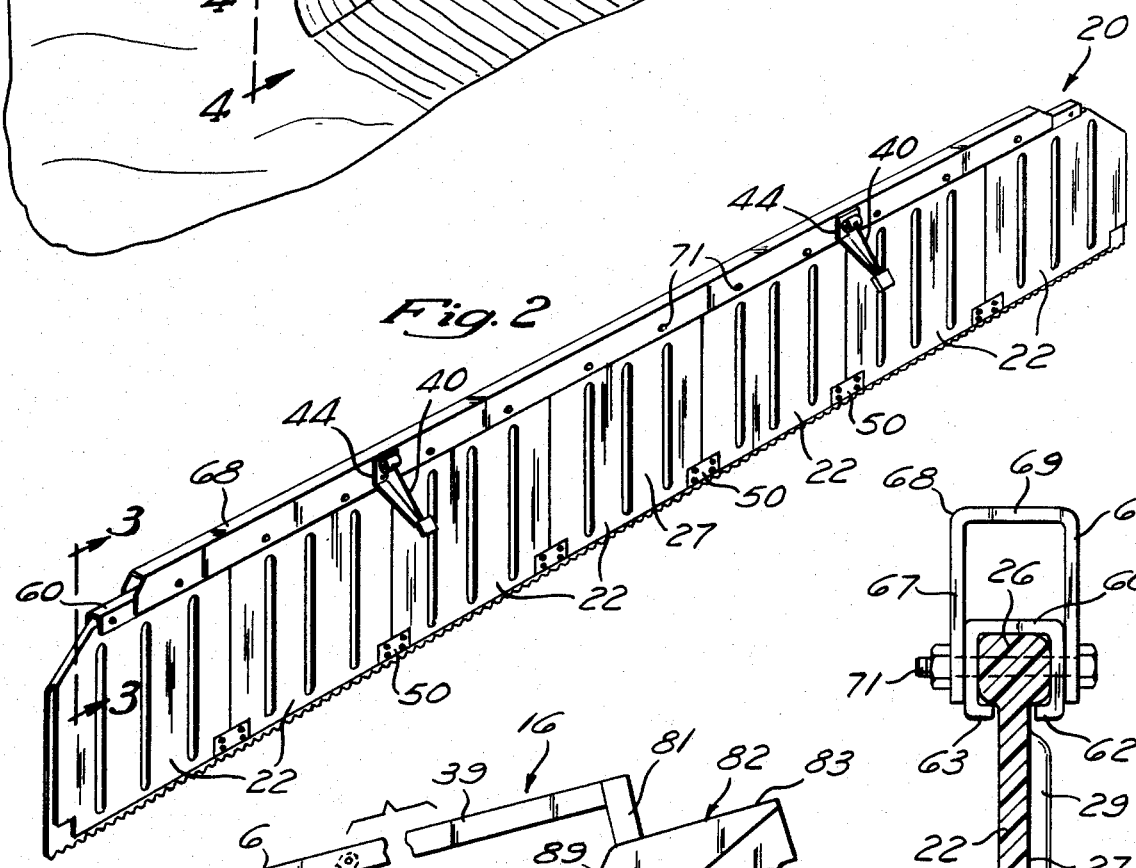
FIG. 2 is a rear perspective view of the snow packer bar assembly.
Figure 3:
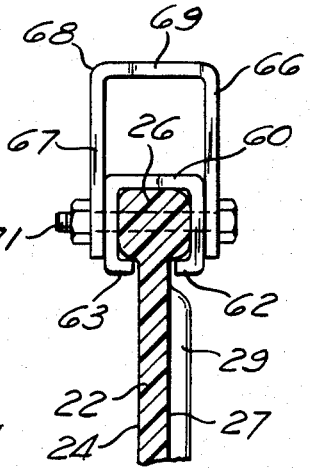
FIG. 3 is a cross-sectional view taken along line 3—3 in FIG. 2.

With reference to FIGS. 2 and 3, the blade assembly includes a plurality of blade segments or panels 22 connected to one another in side by side, edge to edge relation to form an extended blade of a desired width. The blade assembly is at least as wide as the width of the tractor, but can extend further, and can be provided with additional blade wing assemblies that may be kept elevated when not in use and then pivotally lowered into operational position on either end of the blade assembly shown.

Figure 5:
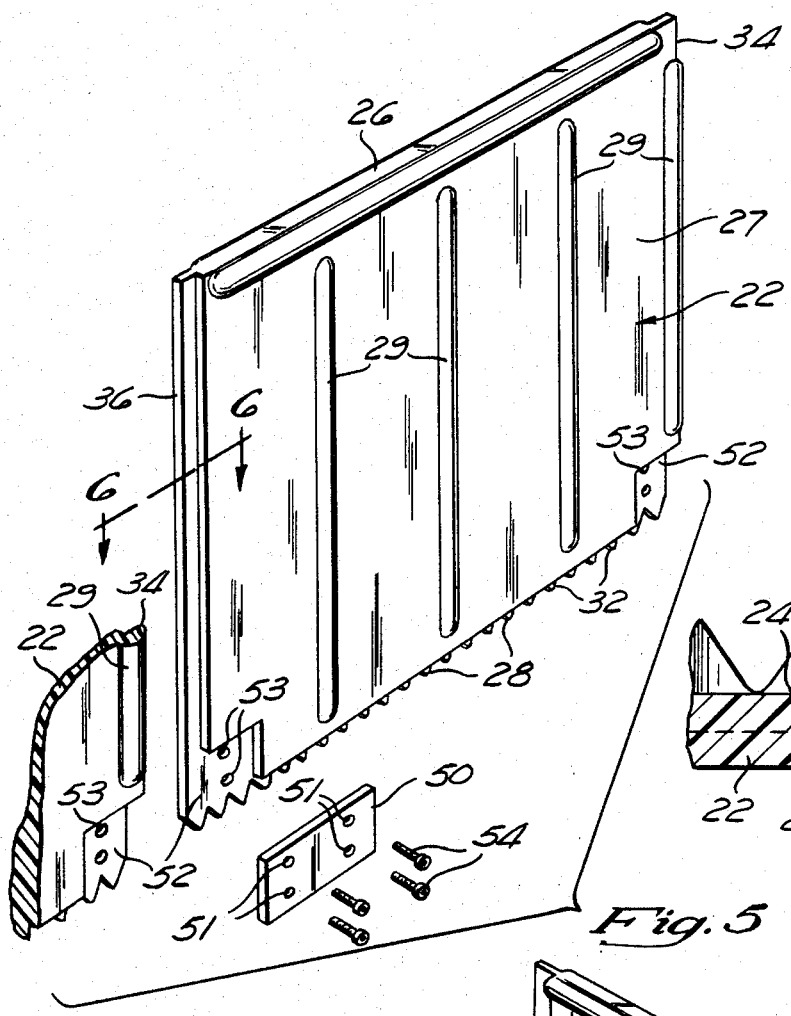
FIG. 5 is an exploded rear perspective view of one complete panel and one broken-away panel.
Figure 6:
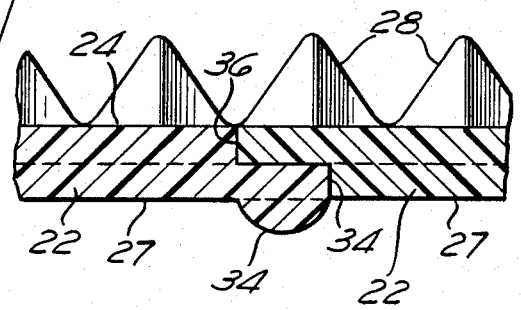
FIG. 6 is a cross-sectional view taken along line 6—6 in FIG. 5.
Figure 7:
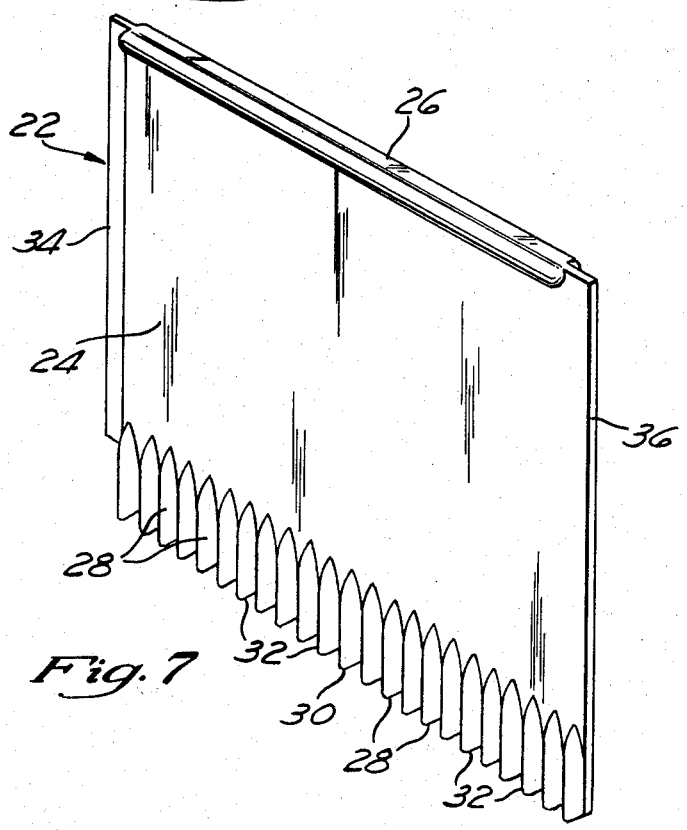
FIG. 7 is a front perspective view of one panel.

The characteristics of a typical blade segment 22 are shown in FIGS. 5, 6 and 7, wherein it may be seen that it has a generally flat, rectangular configuration. The front or snow engaging surface 24 of the panel has a series of parallel, comb-like ridges or teeth 28 which are perpendicular to the panel upper edge 26 and lower edge 30, and parallel to the side edges 34 and 36. As may be seen from FIGS. 6 and 7, the teeth or ridges 28 have a generally v-shaped cross section that form a series of v-shaped notches 32, with the notches forming valleys between the ridges. The upper or non-snow engaging side 27 of the panel 22 is generally flat, but it also includes a plurality of spaced ribs 29 which extend generally parallel to the teeth or ridges 28.

The panel upper edge 26 is enlarged to provide a mounting rib or bead. One side edge 34 is grooved or recessed on the snow engaging side of the panel, while the opposite side edge 36 is grooved on the upper or back surface 27. The depth and width of these grooved edges are similar so that the edge of one element will overlap and mate with the edge of an adjacent element, as best seen in FIG. 6.

While the panels may be made of various sizes, a successful prototype is approximately 2 feet wide or long, 21 inches in height, and about ½ inch thick.

Figure 4:
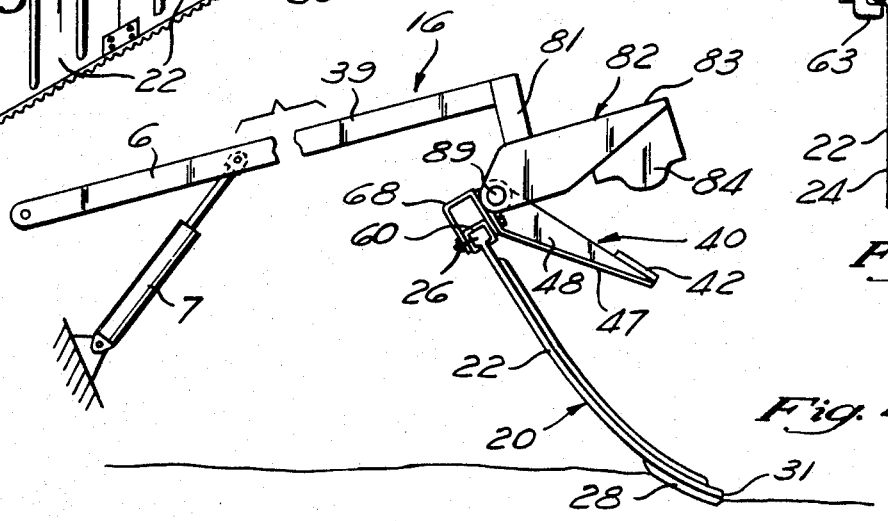
FIG. 4 is a cross-sectional view taken along line 4—4 in FIG. 1.

The blade assembly 20 further includes means for mounting the blade segments 22 in suitable fashion. This includes an inner channel 60 and an outer channel 68, as best seen in FIGS. 2–4. The inner channel 60 is essentially a tube of square cross section having an opening in one edge giving the channel a square cornered c-shaped cross section. In prototype apparatus of the invention, the inner channel 60 was made from 1½ inch square tubing having walls approximately ¼ inch thick. The interior of the channel 60 is sized to slidably receive the enlarged upper edge 26 on a blade segment 22, while the opening formed in the lower side of the channel by the lips or wall segments 62 and 63 are spaced somewhat further than the thickness of the blade segment 22 so that the blade segment may be slid edgewise into the inner channel 60.

The inner channel is preferably formed in sections of convenient length for receiving the blade segments 22. In the arrangement illustrated in FIG. 2, there is provided a series of seven blade segments that are approximately two feet wide so as to create an overall blade assembly width of about fourteen feet. The inner support channel 60 is preferably formed of three sections, including a center section about six feet long that can receive three of the blade segments, and two end inner channel sections that each receive two outer blade segments. The end inner channel sections are less than four feet in that they do not extend completely to the ends of the blade segments, as seen in FIG. 2.

The inner channel 60 is slidably received within an outer channel 68 having a generally U-shaped cross section formed by a pair of side legs 66 and 67 and a bight or base portion 69. The inside dimension between the two legs 66 and 67 is slightly larger than the outside dimension of the inner channel 60 so that the inner channel may be slidably received within the outer channel, as seen in FIG. 3. The height of the outer channel is greater than that of the inner channel so as to provide space for further mounting structure. The outer channel 68 is preferably formed of a single length and has an overall length or width slightly less than the inner channel 60, as seen from FIG. 2.

The outer channel is preferably made of material slightly less strong than the inner channel. Thus, if the channels should strike a large obstruction, such as a rock, the outer channel can bend while the stronger, shorter, inner channel sections might permit such movement at the section lines, without bending themselves. The outer channel can thus be straightened.

In assembling the blade segments to the mounting channels, the upper edge 26 of a blade segment is slid edgewise into the inner channel 60. A section of inner channel 60 connected to its blade segments is then placed within the lower edge of the outer channel. Holes through the blade segment upper edge 26, through the inner channel 60, and through the outer channel 68 are aligned, and bolts 71 are inserted through the assembled elements to secure them together, as seen in FIG. 3. This process is repeated until the entire structure is assembled, as illustrated in FIG. 2.

After the blade segments are attached to the mounting channels, they are further secured together at their lower adjacent edges. Referring to FIGS. 2 and 5, it may be seen that the lower corners of each panel have a generally square, recess 52 with holes 53 formed therein. A connecting rectangular plate 50 fits into two adjacent recesses 52, and holes 51 in those plates are aligned with the holes 53 in the recesses 52. Bolts or self-tapping screws 54 of an appropriate size are then passed through each connecting plate and the corresponding openings in the panel, and the nuts are tightened on the bolts.

Figure 10:
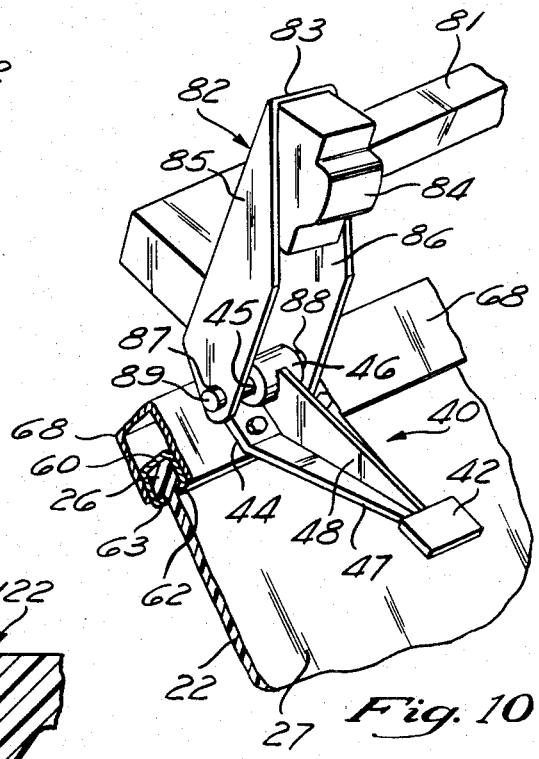
FIG. 10 is a perspective view of the mounting assembly and force receiving arms.

As seen in FIGS. 4 and 10, the blade assembly 20 further includes a pair of novel mounting arms or brackets 40 which are rigidly secured to the upper side of the outer channel 68. Each bracket includes a rectangular fastener plate portion 44 which engages the outer support channel 68 and has several openings therein to receive mounting bolts for facilitating attaching the brackets to the outer channel 68. Angling away from the fastener plate is a main support portion 47 having a force receiving pad 42 on its end remote from the fastener plate 44. Extending centrally and perpendicular to the support 47 is a vertically oriented reinforcing gusset or wall 48 which provides strength and rigidity to the bracket 40. Secured to the gusset 48 directly above the fastener plate 44 is a horizontally oriented tubular pivot 46 having an opening 45 for receiving a mounting pin 87.

Various mounting structures may be employed for connecting the blade assembly 20 to the towing vehicle 10 and for raising and lowering the assembly. The arrangement illustrated includes a pair of spaced, support arms 6 which are pivotally attached directly or indirectly to the rear of the vehicle, and a pair of hydraulic actuators 7 that are pivotally attached directly or indirectly to the vehicle on one end and pivotally attached on the other end to the support arms between their ends. Rigidly attached to the forward ends of the support arms 6 is a cross member 81. Two pressure transfer arms 82 are rigidly secured to the cross member. Each transfer arm has a channel-like, generally U-shaped configuration with the upper or bight portion 83 of the arm 82 being secured to the cross member 81, and with the side legs 85 and 86 of the transfer arm extending downwardly to straddle the force receiving arm 40. In the rear lower portion of the side legs 85 and 86, there are formed two openings 87 and 88 which are aligned with the opening 46 in of the pivot 45 of the force receiving arm 40. The pin or bolt 89 extends through the aligned holes 87, 88 and 46 so that the arms 83 and the cross bar 81 are pivotally attached to the leg assembly. Attached to the lower surface of the rearward end of the bight portion 83 of the transfer arm 82 is a shock absorbing pad 84, made of urethane or other suitable material, that is aligned to engage the pad 42 on the bracket 40.

In operation, the packer bar assembly 16 of the invention is pulled over the surface of the snow, as shown in FIG. 1. More specifically, retracting the hydraulic actuator 7, as shown in FIG. 4, pivots the support arms in a clockwise direction drawing the cross bar 81 downwardly applying downward force on the upper end of the blade assembly. Assuming the lower portion of the blade is engaging snow, as illustrated in FIG. 4, the blade assembly will pivot with respect to the cross bar 81 and the transfer arms 82 until the resilient pad 84 on the arm 82 contacts the pressure pad 42 on the force receiving arm 40. When this contact occurs, the force is transferred through the force receiving arm 40 to the outer channel 68 and inner channel 60. This downward force is thus substantially uniformly dispersed along the outer channel 68 and inner channel 60 blade segments. This force urges the lower end of the blade assembly further into the snow increasing the packing of the snow. If the resistance of the snow increases, the flexible blade segments will flex changing the angle of the lower portion of the blade segments and increasing the amount of the blade surface engagement with the snow. This distributes the load over a wider area as opposed to an increased load in the same area as before the increased resistance. This promotes more uniform packing of the snow. The flexibility of the blade segments also enables the assembly to accommodate irregularity in the condition of the snow, as well as obstructions in the snow. This characteristic of the assembly provides considerable advantage in the grooming of irregular snow surfaces. Note that the angled arm member 47 does not interfere with the flexing of the blade.

As indicated above, the blade is preferably formed of polyurethane or other suitable material having the desired characteristics. These characteristics may be varied to some extent by varying the additives in the urethane. Preferably, the blades will have a resilient hardness measured on Shore hardness scales in the range of 80A to 60D. With the ½ inch blade thickness referred to above, naturally, different thicknesses would offset flexibility. Since the blades are removable relatively easy, it is contemplated that different sets of blade segments will be available having several degrees of resilient hardness for use in various snow conditions. Blades having Shore hardnesses of 91A and 95A appear to provide desirable degrees of hardness.

When the packer assembly is raised by extending the actuator 7 or by pulling the arms 6 forwardly by suitable actuator means (not shown), the assembly will pivot so that the blade segments tend to hange somewhat vertically. This will advantageously cause the snow to fall from the blade due to gravity and the non-stick characteristics of the urethane material. This is in contrast to metal blades to which snow tends to stick.

Figure 8:
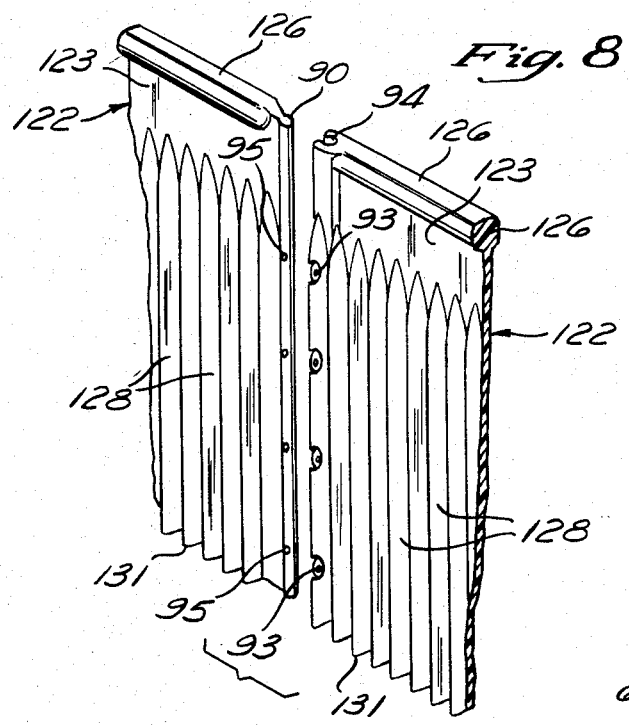
FIG. 8 is a front perspective view showing an alternative means for connecting two urethane panels.
Figure 9:
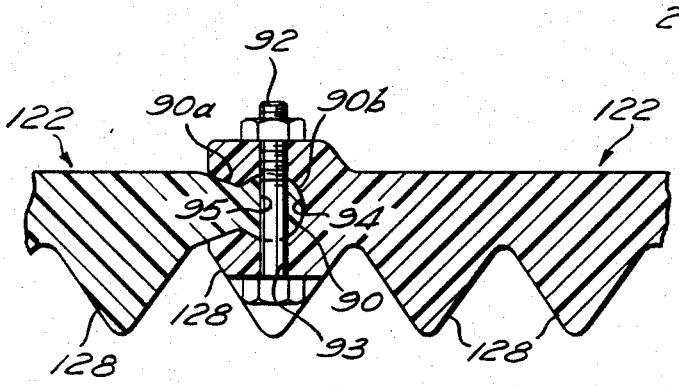
FIG. 9 is a cross-sectional view taken along line 9—9 in FIG. 8.

Referring to FIGS. 8 and 9, an alternate form of blade segment is illustrated. The blade segments 122 are very similar to the segments 22 described above, however, the ridges 128 on the side of the segments to be engaged by the snow extend almost throughout the entire height of the blade segment, leaving only a small space 123 of about 2 inches between the upper ends of the ridges 128 and the rib 126 at the upper edge of the blade segment. This modification ensures that all of the surface engaged by the snow has ridges thereon. Secondly, the longer ridges strenghten the blade segment so that it is no longer necessary to provide reinforcing ribs on the other side of the blade, such as the ribs 29 illustrated in FIG. 5.

One side edge of the blade segment 122 is formed with a laterally extending rib or tongue 90 which extends from the top edge 126 to the bottom edge 131. The tongue includes a reduced neck portion 90*a* and a tip 90*b* which has a diameter about equal to the panel thickness. The opposite edge of each blade segment is formed with a groove 94 shaped to receive the tongue 90 of the adjacent blade segment. Note that a snow grooming ridge 128 is formed on the back surface of the blade segment adjacent that edge, thus providing a thickened area in which the groove 94 can be formed. Additionally, the opposite surface of the blade segment is thickened adjacent the groove edge so that it extends outwardly beyond the primary surface of the blade segment to provide adequate material for forming the structure around the groove 94. The tongue and groove arrangement holds the adjacent segments together, but yet enables them to be readily separated by sliding one segment vertically relative to the other. Note that portions of the structure forming the grooves surround the neck 90*a* of the tongue, helping to make a strong connection.

As an optional feature, to further hold the edges of the segments together, there is provided a plurality of spaced holes 93 through the groove edge of the panel, and aligned holes 95 in the tongue 90. Bolts 92 extend through the holes 93 and 95 and are fastened in that position. The drawing illustrates four holes spaced from the lower edge to the upper edge. It is not mandatory that this many fasteners be employed, and a fastener near the lower edge of the segments is more important than a fastener near the upper end.

The tongue and groove connection requires a slightly different procedure than that described above for connecting the blade segments 22 to the support channels 60. With the arrangement of FIGS. 8 and 9, a first segment is slid edgewise horizontally into an inner channel section 60 until the trailing edge is about to enter the channel. A second blade segment is then vertically aligned so that the tongue and groove edge connection is aligned and the second segment may be vertically moved into side by side, edge to edge position. The two interconnected segments are then slid further into the inner channel. This procedure is followed in connection with the other segments as well.

What is claimed is:

1. Apparatus for grooming snow on a ski slope comprising:

a vehicle for moving over snow; and a packer bar assembly pulled over the snow by said vehicle, said packer bar assembly including a blade assembly comprising a plurality of blade segments positioned in edge to edge, side by side arrangement to form a continuous blade, said blade segments being panel-like elements having ridges on one surface adjacent its lower edge to pack and smooth the snow and form uniform shallow grooves in the snow, as the blade is moved across the snow in an angled position, an inner channel member positioned on the upper edge of the two or more blade segments positioned in side by side, edge to edge relation, an outer channel member receiving two or more inner channel members, said packer bar assembly further including a mounting structure attached to the vehicle including a pair of spaced arms pivotally connected to the vehicle, a cross member extending between the arms, and power means extending between the vehicle and said arms to raise or lower the cross piece, a pair of spaced, force transmitting arms rigidly secured to said cross piece, a pair of force receiving arms rigidly secured to said outer channel of the blade assembly, said force transferring arms and said force receiving arms including a hinged connection by which the blade assembly is carried by the mounting structure, said force transmitting and force receiving arms further including interengaging means for applying a downward force to the blade assembly when the lower edge of the blade assembly is engaging the snow, said blade segments being made of rugged, durable, flexible material such that the blade can flex as the force on it increases causing more surface of the blade to engage the snow.

2. The apparatus of claim 1 wherein said force receiving arms are secured to said outer channel and extend rearwardly over the non-snow engaging side of the blade segment at an angle so as not to interefere with the flexing of the blade, while being located to be engaged by the force transferring arms so as to cause the blade to flex.

3. An apparatus for packing and grooming snow on a ski slope, comprising:

a normally flat blade having an upper edge and a lower edge, a forward, snow engaging side which engages the snow along the lower edge, and a rear, trailing, non-snow engaging side;

a mounting means cooperating with the upper edge of the blade to hold the blade at a desired forward tilt relative to the snow surface being groomed with the upper edge leading the lower edge, and to hold the lower edge at a desired depth beneath the surface of the snow, said mounting means providing a downward force on the blade, said blade comprising the sole snow engaging means secured to said mounting means;

a vehicle connected to said mounting means for pulling the blade over the snow with the blade behind the vehicle and with the upper edge leading, the lower portion of the forward side of the blade being in contact with the snow; and said entire blade being made of a tough, durable material which is flexible in the temperature ranges encountered on ski slopes, and having a height sufficiently greater than its thickness so that the blade can flex into a curved position with the rear, trailing side becoming concave and the forward, leading side becoming convex, said forward side being in contact with the snow, said mounting means downward force causing said blade to flex in response to the resistance of the snow against the blade, said blade being constructed to provide sufficient resistance to flexing so as to provide an automatically varying degree of force and blade surface area in contact with the snow as is needed to pack a snow surface of a varying hardness and level, without requiring any downward force other than that provided by said mounting means.

4. The apparatus of claim 3, wherein the blade has ridges on the lower, snow-engaging portion of the forward side to provide a grooved snow surface, said ridges having a lengthwise axis which is substantially normal to the lower edge of the blade.

5. The apparatus of claim 3 wherein said blade is formed from polyurethane.

6. A blade for grooming and packing the snow on a ski slope, the entire blade being flexible, normally flat and having a forward side and a rear side, a lower edge and an upper edge which both run along the length of the blade, the upper edge to be mounted on a support structure which holds the lower edge at a desired depth beneath the snow and which provides a downward force on the blade, the blade being made of a sufficiently flexible material and having a height sufficiently greater than its thickness so that as the blade is pulled across a snow surface to be groomed with the upper edge leading, the downward force on the blade from the support structure will cause the blade to flex forward as it encounters a harder snow surface or irregularity in the snow surface, and as the entire blade flexes the forward side assumes a convex shape and is pressed into the snow with greater force and with a greater surface area in engagement with the snow, said blade being constructed to provide substantial resistance to flexing so as to automatically flatten and pack the snow to a greater degree in that area, to provide an evenly groomed surface, without requiring continuous adjustments in the position of the blade relative to the snow during use, said blade being adapted to be utilized without attachment to any other snow compacting means.

7. The blade of claim 6 wherein the entire blade is fabricated from polyurethane, is approximately ½ inch in thickness, and is approximately 21 inches in height.

8. A method of packing and grooming the snow on a ski slope, comprising:

pulling a normally flat, flexible blade across the surface to be groomed with the lower edge of the blade engaging and smoothing the snow, said blade being formed entirely from a flexible material and adapted to be utilized without attachment to any other snow engaging means, said blade being pulled by a vehicle, said blade being secured to the vehicle by a mounting means; and providing a downward force on the blade solely with the mounting means, so as to pack the snow beneath the blade and so that when an obstruction, irregularity in the snow surface, or harder snow is encountered by the blade, the mounting means will force the blade to flex into a position with the forward, snow engaging side of the blade forming a convex shape, said blade providing a substantial resistance to flexing which results in a greater packing and leveling force on the snow.

9. A method of packing and grooming the snow on a ski slope, comprising:

pivotably mounting a flexible blade on a support structure so that the blade can pivot about its upper edge and the lower edge of the blade can engage the snow and trail beneath and behind the upper edge, said blade being formed entirely from a flexible material;

pulling the support structure and flexible blade across the surface to be groomed with the lower edge of the blade engaging and smoothing the snow; and limiting the pivoting of the blade to a desired angle so that the blade will first pivot to the point of limitation and then flex as it encounters a raised snow surface or harder snow which requires more force to pack and make even, said blade being constructed to provide substantial resistance to flexing to provide an automatically varying degree of force and blade surface area in contact with the snow as is needed.

10. An apparatus for grooming snow on a ski slope comprising:

a blade having a plurality of ridges on the lower portion of the blade surface which engages the snow;

a mounting structure including a channel member having a slot therein which slidably receives a rib on the upper edge of the blade, to hold the blade at a desired angle with respect to a snow surface to be groomed;

a vehicle connected to the support structure for moving the blade over the snow with the lower surface of the blade in contact with the snow;

said blade being made of a tough, durable material which is flexible in the temperature ranges encountered on ski slopes so that the blade can flex in response to the resistance presented by the snow against the blade;

said blade including a plurality of blade segments and two or more segments are positioned within said channel member; and an outer channel member adapted to slidably receive two or more inner channel members carrying said blade segments.

11. The apparatus of claim 10 including at least one pair of force receiving arms rigidly secured to the channel members and extending rearwardly over the upper surface of the blade to receive a downward force urging the blade to flex.

12. The apparatus of claim 3, wherein:

said blade is formed by a plurality of flexible blade segments which are laterally adjacent along side edges which are normal to the upper and lower edges of the blade, said segments being removably connected along the adjacent side edges.

13. The apparatus of claim 12, wherein the adjacent side edges are connected by means of recesses formed in the blade in which a connecting plate is positioned and attached to the adjoining blade segments.

14. The apparatus of claim 12, wherein:

said blade segments are removably connected by a tongue and groove construction formed on the adjacent side edges of the blade, comprising a tongue extending from one edge of each blade segment, and a corresponding groove formed on the other edge of each segment which slidably receives the tongue of the adjacent blade segment, and a plurality of fasteners extending through the tongue and groove construction to restrain the segment from becoming slidably disengaged.

15. The apparatus of claim 12, wherein each of said blade segments are formed from a single piece of flexible material.

16. The apparatus of claim 3 wherein:

said blade has ridges on the snow engaging forward side, the ridges extending from the lower edge to nearly the upper edge, to provide a grooved snow surface as the blade is flexed into a position where nearly the entire forward side of the blade engages the snow.

17. An apparatus for packing and grooming snow on a ski slope, comprising:

a normally flat blade having an upper edge and a lower edge, a forward, snow engaging side which engages the snow along the lower edge, and a rear, trailing, non-snow engaging side;

a mounting means cooperating with the upper edge of the blade to hold the blade at a desired forward tilt relative to the snow surface being groomed with the upper edge leading the lower edge, and to hold the lower edge at a desired depth beneath the surface of the snow;

a vehicle connected to said mounting means for pulling the blade over the snow with the upper edge leading, the lower portion of the forward side of the blade being in contact with the snow;

said entire blade being made of a tough, durable material which is flexible in the temperature ranges encountered on ski slopes and having a height sufficiently greater than its thickness so that the blade can flex into a curved position with the rear, trailing side becoming concave and the forward, leading side becoming convex, said forward side being in contact with the snow, said blade flexing in response to the resistance of the snow against the blade to provide an automatically varying degree of force and blade surface area in contact with the snow as is needed to pack a snow surface of a varying hardness and level; and said blade is pivotally suspended by said mounting means to enable the blade to rotate from a vertical position so that the lower, snow engaging portion of the blade trails beneath and behind the upper portion, said rotation being limited by a force receiving assembly comprising a stationary member and a pivoting member which pivots with the blade and which becomes engaged with the stationary member when the blade has rotated to a predetermined degree, the engagement of said stationary member and said pivoting member preventing further rotation of the blade, resulting in a downward force on the blade, urging the blade to flex and exert a greater packing force onto the snow beneath it.

18. The apparatus of claim 17, wherein said mounting means is itself pivotably mounted on the vehicle to raise and lower the blade relative to the snow surface.

19. An apparatus for packing and grooming snow on a ski slope, comprising:

a normally flat blade having an upper edge and a lower edge, a forward, snow engaging side which engages the snow along the lower edge, and a rear, trailing, non-snow engaging side;

a mounting means cooperating with the upper edge of the blade to hold the blade at a desired forward tilt relative to the snow surface being groomed with the upper edge leading the lower edge, and to hold the lower edge at a desired depth beneath the surface of the snow;

a vehicle connected to said mounting means for pulling the blade over the snow with the upper edge leading, the lower portion of the forward side of the blade being in contact with the snow;

said entire blade being made of a tough, durable material which is flexible in the temperature ranges encountered on ski slopes and having a height sufficiently greater than its thickness so that the blade can flex into a curved position with the rear, trailing side becoming concave and the forward, leading side becoming convex, said forward side being in contact with the snow, said blade flexing in response to the resistance of the snow against the blade to provide an automatically varying degree of force and blade surface area in contact with the snow as is needed to pack a snow surface of a varying hardness and level;

said blade is formed by a plurality of flexible blade segments which are laterally adjacent along side edges which are normal to the upper and lower edges of the blade, said segments being removably connected along the adjacent side edges; and wherein the adjacent side edges are connected by means of recesses formed in the blade in which a connecting plate is positioned and attached to the adjoining blade segments.

20. An apparatus for packing and grooming snow on a ski slope, comprising:

a normally flat blade having an upper edge and a lower edge, a forward, snow engaging side which engages the snow along the lower edge, and a rear, trailing, non-snow engaging side;

a mounting means cooperating with the upper edge of the blade to hold the blade at a desired forward tilt relative to the snow surface being groomed with the upper edge leading the lower edge, and to hold the lower edge at a desired depth beneath the surface of the snow;

a vehicle connected to said mounting means for pulling the blade over the snow with the upper edge leading, the lower portion of the forward side of the blade being in contact with the snow;

said entire blade being made of a tough, durable material which is flexible in the temperature ranges encountered on ski slopes and having a height sufficiently greater than its thickness so that the blade can flex into a curved position with the rear, trailing side becoming concave and the forward, leading side becoming convex, said forward side being in contact with the snow, said blade flexing in response to the resistance of the snow against the blade to provide an automatically varying degree of force and blade surface area in contact with the snow as is needed to pack a snow surface of a varying hardness and level;

said blade is formed by a plurality of flexible blade segments which are laterally adjacent along side edges which are normal to the upper and lower edges of the blade, said segments being removably connected along the adjacent side edges; and wherein said blade segments are removably connected by a tongue and groove construction formed on the adjacent side edges of the blade, comprising a tongue extending from one edge of said blade segment, and a corresponding groove formed on the other edge of each segment which slidably receives the tongue of the adjacent blade segment, and a plurality of fasteners extending through the tongue and groove construction to restrain the segment from becoming slidably disengaged.

21. An apparatus for packing and grooming snow on a ski slope, comprising:

a normally flat blade having an upper edge and a lower edge, a forward, snow engaging side which engages the snow along the lower edge, and a rear, trailing, non-snow engaging side;

a mounting means cooperating with the upper edge of the blade to hold the blade at a desired forward tilt relative to the snow surface being groomed with the upper edge leading the lower edge, and to hold the lower edge at a desired depth beneath the surface of the snow;

a vehicle connected to said mounting means for pulling the blade over the snow with the upper edge leading, the lower portion of the forward side of the blade being in contact with the snow;

said entire blade being made of a tough, durable material which is flexible in the temperature ranges encountered on ski slopes and having a height sufficiently greater than its thickness so that the blade can flex into a curved position with the rear, trailing side becoming concave and the forward, leading side becoming convex, said forward side being in contact with the snow, said blade flexing in response to the resistance of the snow against the blade, said blade being constructed to provide substantial resistance to flexing so as to provide an automatically varying degree of force and blade surface area in contact with the snow as is needed to pack a snow surface of a varying hardness and level;

said blade is formed by a plurality of flexible blade segments which are laterally adjacent along said edges which are normal to the upper and lower edges of the blade, said segments being removably connected along the adjacent side edges; and wherein the adjacent side edges are connected by means of recesses formed in the blade in which a connecting plate is positioned and attached to the adjoining blade segments.

22. The apparatus of claim 21 wherein said blade segments are removably connected by a tongue and groove construction formed on the adjacent side edges of the blade, comprising a tongue extending from one edge of each blade segment, and a corresponding groove formed on the other edge of each segment which slidably receives the tongue of the adjacent blade segment, and a plurality of fasteners extending through the tongue and groove construction to restrain the segment from becoming slidably disengaged.

* * * * *